United States Patent [19]

Blackerby

[11] Patent Number: 4,866,580

[45] Date of Patent: Sep. 12, 1989

[54] ORNAMENTAL LIGHTING DEVICE

[76] Inventor: Carol Blackerby, 32 Philip Rd., Cape Elizabeth, Me. 04107

[21] Appl. No.: 185,777

[22] Filed: Apr. 25, 1988

[51] Int. Cl.[4] ..... F21L 15/14

[52] U.S. Cl. ..... 362/205; 362/191; 362/800; 362/802; 362/810

[58] Field of Search ..... 362/184, 205, 800, 802, 362/806, 810, 191

[56] References Cited

U.S. PATENT DOCUMENTS

| | | | |
|---|---|---|---|
| 4,097,917 | 6/1978 | McCaslin | 362/800 X |
| 4,215,388 | 7/1980 | Reimann | 362/800 X |
| 4,423,473 | 12/1983 | Kirkley | 362/800 X |
| 4,433,362 | 2/1984 | Ban | 362/802 X |
| 4,459,645 | 7/1984 | Glatter | 362/800 X |

*Primary Examiner*—Stephen F. Husar

*Attorney, Agent, or Firm*—Edward A. Gordon

[57] ABSTRACT

A self-powered ornamental lighting device includes a housing wall defining a chamber therein and a power source disposed in the housing chamber. One or more LEDS are mounted in the housing wall whereby light emitted by the LED is transmitted to the ambience. Circuit means are disposed in the housing chamber for connecting the power supply and the LEDS for causing the LEDS to emit light. A removable cover member provides access to the housing chamber. In one embodiment of the invention the LEDS are provided with light enhancing members which serve to disburse, direct, reflect or otherwise modify the light emitted from the LEDS. In another embodiment of the invention a remote control system is provided for control of the on/-off function of the lighting device.

10 Claims, 3 Drawing Sheets

ORNAMENTAL LIGHTING DEVICE

FIELD OF THE INVENTION

The present invention relates generally to lighting devices, and more particularly to self-powered illuminated ornaments for holiday decorations.

BACKGROUND OF THE INVENTION

There are many types of illuminated ornamental devices presently available to the public. As is well known, there are numerous ornamental devices which operate from a conventional A.C. circuit outlet, thereby, requiring the use of unsightly wires and consuming energy which could be better used for productive purposes. Also the 120 volt A.C. associated with such wired assemblies presents a shock hazard to persons handling the ornaments associated wire circuitry. An example of such prior art devices is the well known electric light string set comprising a current supply line, a plurality of socket sections and a plurality of lamps or bulbs associated with each socket. Such assemblies are connected in series or parallel to provide a completed set of lights such as are employed to decorate Christmas trees, for example. Examples of such prior art devices are disclosed in U.S. Pat. Nos. 3,504,169 and 4,516,193. Other illuminated ornamental devices of the prior art include self-powered devices in which the illuminated ornament is provided with a self-contained power supply. Examples of such prior art devices are disclosed in U.S. Pat. Nos. 4,170,036 and 4,271,457. In U.S. Pat. No. 3,873,880 there is disclosed a self-powered illuminated ornamental device in which a power supply, a plurality of gas-discharge tubes and a plurality of circuit means connecting the power supply and the gas-discharge tube are disposed within the ornament. While such prior art devices provide improvement in the areas intended, there is still a great need for a simple, economical self-powered illuminated ornamental device.

Accordingly, a principal desirable object of the present invention is to provide a self-powered illuminated ornamental device which is simple and economical to construct.

Another desirable object of the present invention is to provide a generally improved self-powered illuminated ornamental device.

A still further desirable object of the present invention is to provide a self-powered illuminated ornamental device which is capable of illuminating the ambience without generating substantial heat and therefor does not present an electrical shock, fire or burn hazard.

A further desirable object of the present invention is to provide a self-powered illuminated ornamental device which can be operated by means of remote control.

Another desirable object of the present invention is to provide a self-powered illuminated device which is sufficiently economical to manufacture whereby the device may be employed as a disposable unit.

These and other desirable objects and advantages of the invention will in part appear hereinafter and will in part become apparent after consideration of the specification with reference to the accompanying drawings.

SUMMARY OF THE INVENTION

In accordance with the present invention, there is disclosed an ornamental lighting device having a self-contained power supply. The illuminating elements are light emitting diodes (LEDS) connected in a series or parallel circuitry powered by one or more series connected batteries. The circuit can be provided with a blinking LED in series with one or more non-blinking LEDS to provide a circuit for intermittently effecting the flashing of the non-blinking LEDS to provide a flashing circuit. The LED can be provided with light enhancing members which serve to disburse, direct, reflect or otherwise modify the light emitted from the LEDS. The invention also contemplates an ornamental lighting device which can be operated by remote control.

BRIEF DESCRIPTION OF THE DRAWING

For a fuller understanding of the nature and desired objects of this invention, reference should be made to the following detailed description taken in connection with the accompanying drawing, wherein like reference characters refer to corresponding parts throughout the several views of the preferred embodiments of the invention and wherein.

DETAILED DESCRIPTION OF THE PREFERRED EMBODIMENTS

Figure 1:
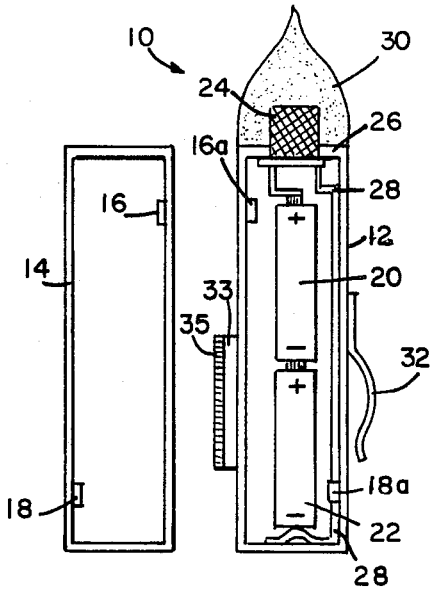
FIG. 1 is a perspective view of an ornamental lighting device incorporating features of the invention in accordance with one embodiment thereof.

Referring now to FIG. 1 of the drawing, there is illustrated generally at 10 an embodiment of the ornamental lighting device in accordance with the invention. As shown, the article 10 is in the form of an ornamental light of the type used for light sets and has an elongated hollow housing 12 having a removable cover member 14. The cover 14 is releasably attached to housing 12 by mating frictional members 16, **16*a* and 18, 18*a*. Members 16 and 18 are suitably lip members which fit inside of and frictionally engage their respective mating edge members 16*a* and 18*a*. Disposed inside the housing 12 is the power supply which may comprise a pair of batteries 20 and 22 connected in series. A light emitting diode, LED, 24 is disposed in the housing wall 26 and connected in series by means of conductor 28 with batteries 20 and 22 and a suitable voltage control resistor R1. Disposed about a portion of the LED 24 is a light transmitting enhancement member 30**. In a preferred embodiment, suitable means are provided for attaching or mounting the device in a desired location.

Figure 3:
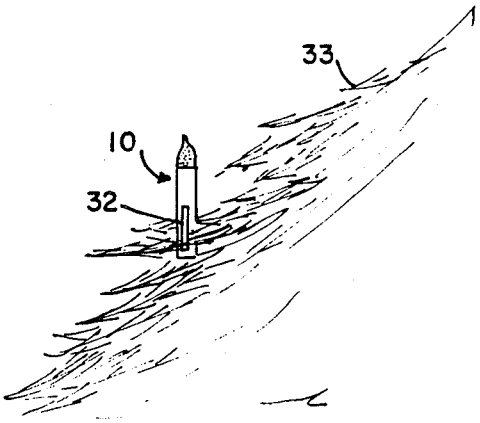
FIG. 3 is a fragmentary perspective view of the ornamental lighting device of FIG. 1 as used as a tree decoration.

As show, the means for attaching or mounting the device 10 is a flexible clamp means 32 which is attached to the housing 12 at one end and open at the other end. In an alternate embodiment, the means for attaching the device 10 can be pieces or patches 33 and 35 of fabric with upstanding mating interlocking fibers such as, for example, the material sold under the trade name "Velcro". A suitable LED can, for example, be a high-brightness LED of the type sold commercially and having the following ratings: a continuous forward current of 50 mA; a forward voltage (@ 20 mA) of 2.5 V; a reverse voltage of 4 V; and a power dissipation of 100 mw; and the following electro-optical characteristics: a forward voltage of 1.75 V; a forward current of 20 mA; a luminous intensity of 500 mcd; a peak wave length of 660 nm; and a special line half width of 25 nm. Additionally suitable color emitting LEDS can be employed which emit colors such as red, green or yellow, for example. Also LEDS with fresnel lens fronts can be employed to enhance the lighting effect. Suitable batteries can be of the nickel-cadmium triple A (AAA) 1.5 V type and size. Such ornamental lighting devices can be mounted on a tree 33 as a decoration as shown in FIG. 3. One or more of such ornamental lighting devices can be suitably mounted in windows, on stair banisters, wreathes and the like to provide a decorative effect. The light enhancing member 30 can be in the form of a bulb surrounding the LED or a solid structure each preferably formed of glass or plastic material. The configuration as well as the color can be varied so long as the material remains light transmitting. Additionally material forming the light enhancement member can be dispersed with reflective metal foil for additional ornamental lighting effect. Other lighting effects can be provided by employing materials having different refractive indexes.

Figure 4:
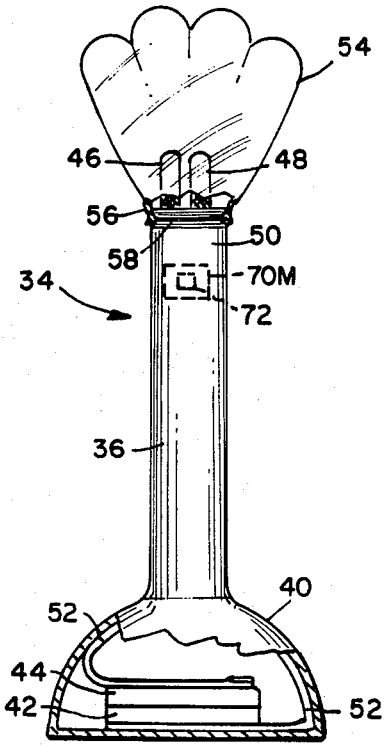
FIG. 4 is a side plan view, partly broken away, illustrating a second embodiment of an ornamental lighting device in accordance with the invention.
Figure 5:
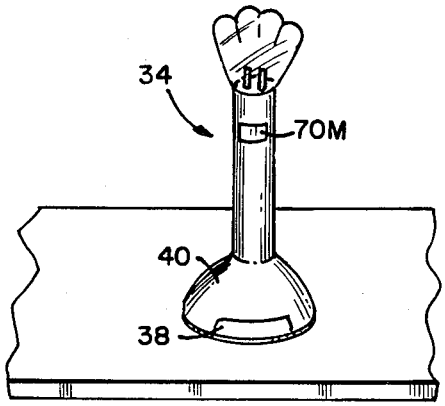
FIG. 5 is a perspective view of the ornamental lighting device illustrated in FIG. 4.

Referring now to FIGS. 4 and 5, there is illustrated an alternate embodiment of an ornamental lighting device in accordance with the invention. The ornamental lighting device, shown generally by the numeral 34, is in the form of a decorative candle, and includes a housing 36 having a removable cover member 38 disposed in the base portion 40 of device 34. The cover member 38 can be releasably attached to the housing by frictional members (not shown) of the type discussed with respect to the cover 14 of FIG. 1. Disposed within the base portion 40 is a power supply which may comprise a pair of button shaped batteries 42 and 44. A blinking LED 46 and a high brightness LED 48 are disposed in the upper end portion 50 of the housing 36. The LEDS 46 and 48 are connected electrically in series with the suitable voltage control resistor R2 and batteries 42 and 44 by conductor 52. Disposed upon the upper portion 50 of the housing 36 is a reflector member 54. The reflector member 54 can be constructed so as to be rotatable with respect to the housing 36. Rotation of the reflector member 54 can be provided by means of the mating of convex surface 56 of reflector 54 and concave surface 58 of the housing 36. The reflector 54 can be formed of suitable metal foil which may be tinted with various colors as is well known. While the reflector 54 is illustrated as partially encircling the LEDS, it is to be understood that other configurations and dimensions can be employed as well as a light transmitting enhancement member such as the member 30 discussed with respect to FIG. 1. In this embodiment, the blinking LED is a commercially available LED having the following ratings: a supply voltage of 5 VDC; an on-state forward current of 80 mA; and a reverse voltage of 0.4 VDC; and the following electro-optical characteristics: a supply voltage of 2.5–5.0 VDC (3 V typ.); an on-state forward current of 55 mA; a peak wave length of 697 nm; a blink rate of 0.5–3.0 Hz (2.0 Hz typ.) and a luminous intensity of 1.2 mcd (typ. @ 3 V). The high intensity LED 48 can be of the type described with respect to FIG. 1. The button shaped batteries 42 and 44 can be lithium mangenese dioxide batteries each having a voltage of at least 3 V and a service capacity of 70 to 200 mAh. The flat upper and lower surfaces of such batteries form the positive and negative terminals as is well known.

Figure 2:
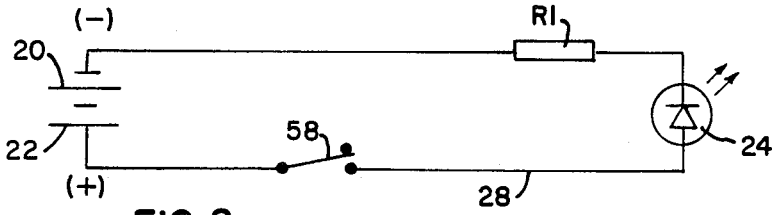
FIG. 2 is a schematic view of one electric circuit suitable with the ornamental lighting device of the type illustrated in FIG. 1.
Figure 6:
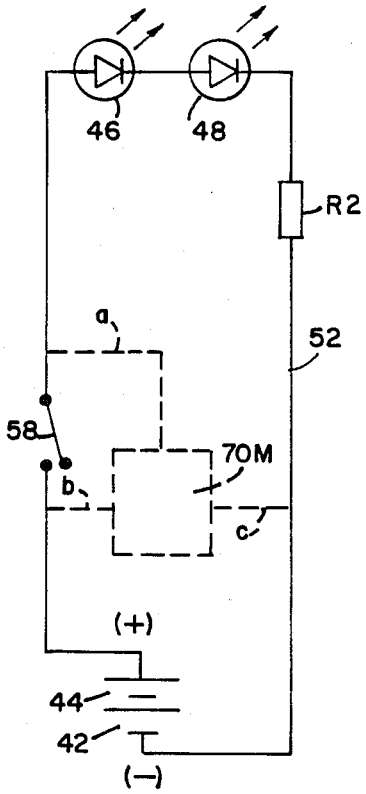
FIG. 6 is a schematic view of another electric circuit suitable with the ornamental lighting device of the type illustrated in FIG. 4.
Figure 7:
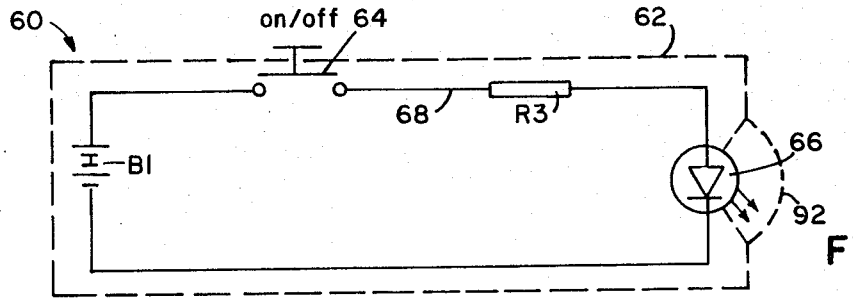
FIG. 7 is a schematic view of a circuit diagram of a transmitter of a remote control system employed in one embodiment of the present invention.

Referring now to FIGS. 2 and 6, it will be understood that the electric circuits illustrated are suitable for the ornamental lighting devices of FIGS. 1 and 4 respectively. In the schematic diagram of FIG. 6, the blinking or flashing LED 46 in series with LED 48 causes LED 48 to blink or flash simultaneously with LED 46. While such schematic circuits are suitable, other circuit modifications can be made within the scope of the invention. The device 10 of FIG. 1 can be provided with a flashing LED. Similarly, all non-flashing LEDS can be employed in the circuit of FIG. 6. Also additional LEDS can be employed in the circuits to augment the lighting and ornamental design of the lighting device.

The ornamental lighting devices of the present invention provide a simple, economical continuous ornamental and decorative light for the duration of the battery power source. For example, the lighting devices of the present invention will provide for continuous lighting for long periods of time, that is, days or weeks after which the batteries can be replaced. However, it is within the contemplation of the invention to employ ON/OFF switches such as switch 58 of FIGS. 2 and 6 to conserve energy.

Figure 8:
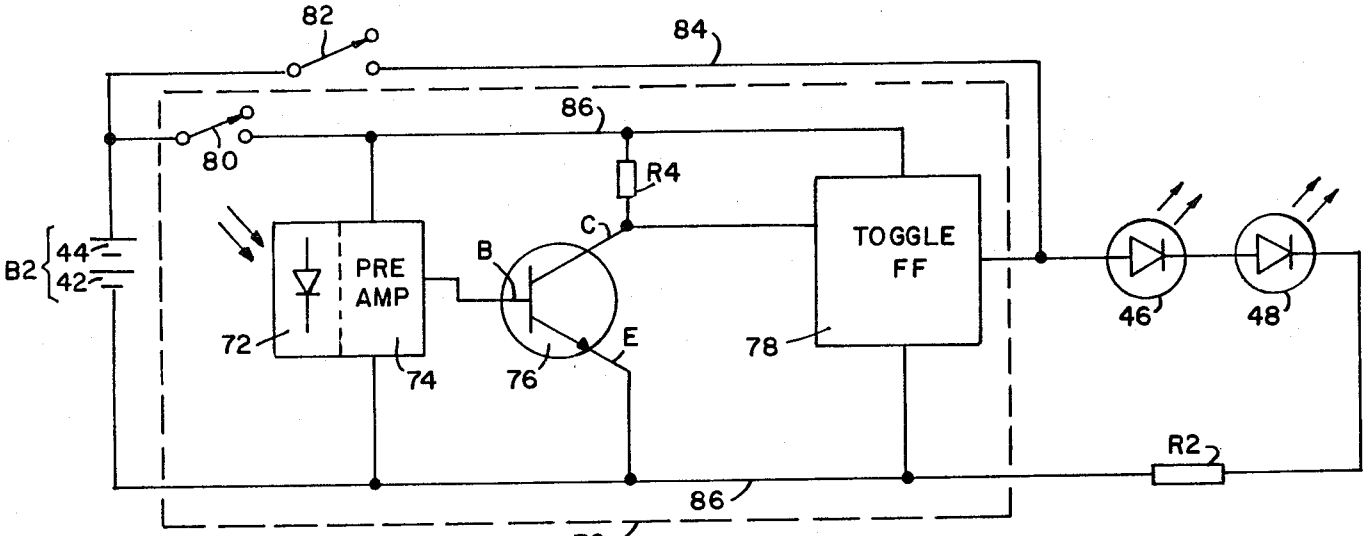
FIG. 8 is a schematic view of a circuit diagram of a receiver of the remote control system employed with the embodiment of FIG. 7.

Referring now more particularly to FIGS. 6–9, there is illustrated a remote control system comprising an infrared remote control circuit for remotely controlling the ON/OFF function of the ornamental lighting device of the present invention. The infrared remote control system comprises a transmitter shown generally by the numeral 60 of FIG. 7 for transmitting ON/OFF control signals and a receiver 70 shown by the dotted line of FIG. 8 for receiving the control signals. In accordance with this embodiment of the present invention the control signals received are employed to function as an ON/OFF switch for the ornamental lighting device of the present invention. As illustrated, the components of the circuit of the transmitter 60 are accommodated in a suitable conveniently sized housing 62 illustrated by the dotted line. The circuit includes a power source such as battery B1, for example, a 3 to 9 volt battery connected in series with an ON/OFF switch 64, a current limiting resistor R3 and an infrared emitting diode 66. In operation when the switch 64 is actuated to the ON position, the current flows through the conductor 68, through the current limiting resistor R3 and the infrared photodiode 66 to cause the diode to provide an output infrared light pulse. The receiver device is accommodated in the electric circuit of the ornamental lighting device (for example, the ornamental lighting device of FIG. 4) as schematically shown by the dotted line 70 of FIG. 8. Referring now more particularly to FIG. 8, the circuit of receiver 70 includes an infrared receiving photodiode 72 which is connected to a pre-amplifier 74. The pre-amplifier 74 provides at its output a pulse which is similar to the pulse output of the infrared photodiode 66. The output of the pre-amplifier 74 is applied to the base B of an NPN transistor 76. The voltage control resistor R4 is in series with the collector C of the transistor 76. The output of the transistor 76 is connected to the TOGGLE input of a conventional FLIPFLOP (FF) toggle switch 78. The circuit of the FF switch 78 provides two stable states, ON or OFF. It remains in one state until switched to the other state by the output of the transistor signal. The output of FF switch 78 is connected in series with light emitting diodes 46 and 48, current limiting resistor R2 and power source B2, for example, batteries 42 and 44. As illustrated in FIG. 8, the receiver circuit can be provided with an ON/OFF switch 80. Also an override switch 82 can be provided in series in the lighting circuit conductor 84 so that the light emitting diodes 46 and 48 can be continuously operated in the ON mode. It is to be understood that switch 82 must be in the OFF position for the receiver 70 to be operated.

In operation of the infrared system, when infrared diode 72 of receiver 70 receives the signal pulse from the diode 66 of the transmitter 60, the transistor 76 is switched to the conductive state and the resulting output signal activates the FF toggle switch 78 to change the switch from, for example, its OFF state to its ON state whereby current flows to the LEDS 46 and 48 to actuate lighting thereof via conductor 86. The circuit remains in the ON state until the infrared diode 72 is again pulsed by the transmitter photodiode 66 and the process repeated as described above but with the difference that the FF toggle switch 78 is switched to the OFF state thereby interrupting the current flow to LEDS 46 and 48 with the result that they are turned OFF.

Figure 9:
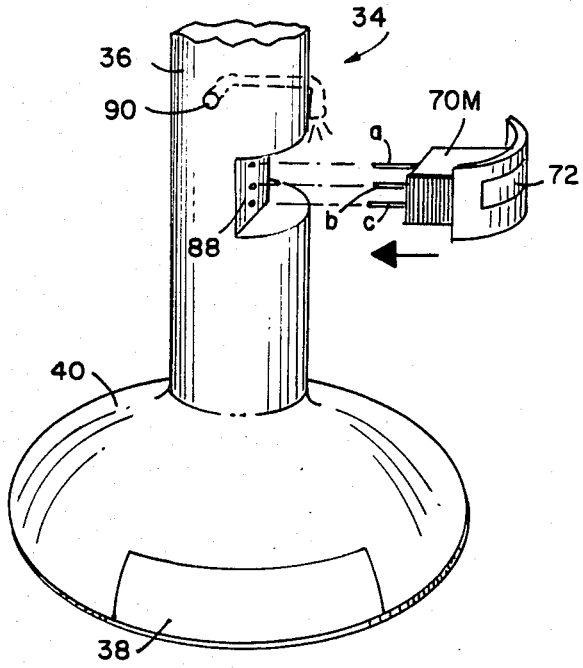
FIG. 9 is a fragmentary perspective view of the ornamental lighting device of FIG. 4 and including a plug-in modular remote control receiver of FIG. 8.

Referring now more particularly to FIG. 9, it can be appreciated that the infrared receiver 70 can be constructed and arranged as a plug-in module 70M which is configured to be plugged into the housing 36, for example, of ornamental lighting device 34. As shown, the prongs a, b and c would provide electrical connection as shown in FIG. 6 when plugged into socket 88 of FIG. 9. Additionally, the ornamental device 34 can be provided with one or more fiber optic members 90 (FIG. 9) disposed about the housing 36 to allow the photodiode 72 to receive the infrared pulse from the transmitter 60 from any position of transmission within 360° about the ornamental device 34. Similarly, the transmitter 60 can be provided with a wide angle light transmission lens 92 to diversify the infrared pulse transmission signal.

While the invention has been described with respect to preferred embodiments, it will be apparent to those skilled in the art that changes and modifications may be made without departing from the scope of the invention herein involved in its broader aspects. Accordingly, it is intended that all matter contained in the above description or shown in the accompanying drawing shall be interpreted as illustrative and not in limiting sense.

What is claimed is:

1. A self-powered ornamental lighting device comprising:
- a housing wall defining a chamber therein;
- a power source disposed in said housing chamber;
- at least one LED mounted in said housing wall whereby light emitted by said LED is transmitted to the ambience;
- circuit means disposed in said housing chamber connecting said power supply and said LED for causing said LED to emit light;
- means for switchably connecting said power source to said LED;
- a light enhancing member configured to simulate a flame associated with each LED for propagating the light emitted from the LED; and
- a removable cover means providing access to said housing chamber.

2. The ornamental device of claim 1 in the form of a Christmas tree light.

3. The ornamental device of claim 1 in the form of a miniature candle light.

4. The self-powered ornamental lighting device of claim 1 wherein said means for switchably connecting said power source to said LED is remotely controllable.

5. A remote controlled self-powered ornamental lighting device actuated to the on state and off state by means of a signal pulse transmitted via infrared radiation comprising:
- a housing wall defining a chamber therein;
- a power source disposed in said housing chamber;
- at least one LED mounted in said housing wall whereby light emitted by said LED is transmitted to the ambience;
- circuit means disposed in said housing chamber connecting said power supply and said LED for causing said LED to emit light; and
- a receiver for said radiated signal pulse electrically connected to said circuit means comprising:
- means for transforming the received radiation signal pulse into an electrical signal;
- means for amplifying said electrical signal; and
- switch means having one end connected to the output of said amplifier and the other end connected in series with said LED;
- said switch means providing a conductive state and a non-conductive state in response to said electrical signal to thereby control the actuation of said lighting device.

6. The ornamental lighting device of claim 5 further including a light enhancing member associated with the LEDS for enhancing the light emitted thereby.

7. The ornamental lighting device of claim 5 further including means for removably attaching said ornamental lighting device to a supporting structure.

8. A self-powered ornamental lighting device comprising:
- a housing wall defining a chamber therein;
- a power source disposed in said housing chamber;
- at least one LED mounted in said housing wall whereby light emitted by said LED is transmitted to the ambience;
- circuit means disposed in said housing chamber connecting the power source and the LED for causing said LED to emit light;
- a receiver means connected to said power source for receiving a control signal pulse;
- said receiver means including a switching circuit switchable between an on stage and an off stage in response to the control signal pulse; and
- at least one fiber optical conductor mounted adjacent said housing wall so as to conduct a control signal pulse from a control signal pulse transmitter position angular to the line-of-sight plane of said receiver.

9. The ornamental lighting device of claim 8 further including a light enhancing member associated with the LEDS for enhancing the light emitted thereby.

10. The ornamental lighting device of claim 8 further including means for removably attaching said ornamental lighting device to a supporting structure.

* * * * *